US005178427A

United States Patent [19]

Jorritsma

[11] Patent Number: 5,178,427

[45] Date of Patent: Jan. 12, 1993

[54] SELF-RELEASING LIFT HOOK

[76] Inventor: Johannes N. Jorritsma, 37 Yonge Street N., Aurora, Ontario, Canada, L4G 1N6

[21] Appl. No.: 824,528

[22] Filed: Jan. 23, 1992

[51] Int. Cl.[5] ..... B66C 1/38

[52] U.S. Cl. ..... 294/82.36; 294/82.3

[58] Field of Search ..... 294/82.16, 82.24, 82.3, 294/82.31, 82.33, 82.36, 88

[56] References Cited

U.S. PATENT DOCUMENTS

| | | | |
|---|---|---|---|
| 2,131,445 | 9/1938 | Lawton | 294/82.33 |
| 2,490,558 | 12/1949 | Sullivan . | |
| 3,259,419 | 7/1966 | Schwarzbach | 294/82.36 |
| 3,259,420 | 7/1966 | Klemm . | |
| 4,095,833 | 6/1978 | Lewis . | |
| 4,416,480 | 11/1983 | Moody | 294/82.3 |
| 4,767,144 | 8/1988 | Hörnberg | 294/82.36 |

FOREIGN PATENT DOCUMENTS

| | | | |
|---|---|---|---|
| 235560 | 1/1969 | U.S.S.R. | 294/82.31 |
| 1079593 | 3/1984 | U.S.S.R. | 294/82.36 |
| 1079594 | 3/1984 | U.S.S.R. | 294/82.36 |
| 1477651 | 5/1989 | U.S.S.R. | 294/82.36 |

*Primary Examiner*—Charles A. Marmor
*Assistant Examiner*—Dean J. Kramer
*Attorney, Agent, or Firm*—Shoemaker and Mattare, Ltd.

[57] ABSTRACT

A self-releasing lift hook includes a main cylinder with a main piston slidable in the cylinder and defining a main chamber above the piston and a main chamber below the piston. A hook is connected to one of the cylinder and the piston, and a lift ring is connected to the other. A coil spring biases the piston in a direction which causes the hook and the ring to approach each other, so that when a load is placed on the hook, the hook and ring move apart and cause energy to be stored in the spring. A main passage through the piston, incorporating a check valve, allows fluid to flow between the main chambers when the hook and ring are moving apart, but restrains such fluid flow when the hook and ring approach each other. A bleed passage is provided through the piston to allow slow transfer of fluid from one side to the other of the piston. A hydraulic accessory is activated by an increase of fluid pressure in the chamber that decreases in volume when the hook and ring approach each other, and a mechanical connection, activated by the hydraulic arrangement, causes a load attachment to be disengaged from the hook.

20 Claims, 4 Drawing Sheets

SELF-RELEASING LIFT HOOK

This invention relates generally to lift hooks, and has to do particularly with a self-releasing lift hook which automatically and instantaneously releases from its load on impact or upon placing the load on a deck or the like.

BACKGROUND OF THIS INVENTION

Crane-supported hooks are widely used for moving heavy loads to or from docks, ship decks, solid land, the sea bottom, and so on. It is of great advantage if, upon "touch down" of the load, the hook will automatically release itself from the load by pushing a cable or shackle out of engagement with the hook, in such a way that it will stay out of engagement for a period of time such as 10 seconds. This is particularly useful when the location of the "touch down" of the load is not easily reached by a person in order to disconnect the hook from the load. Similar problems arise when the load and the place of "touch down" are moving in an uncontrolled manner towards or away from each other, for example from one ship to another ship, from a helicopter, for lowering lifeboats, and so on. By providing immediate release of the load from the hook, there is no danger that the load will be lifted again, and no likelihood of smashing or pounding. The safety aspect of this provision is particularly highlighted when handling bombs, torpedoes, radio equipment, wounded personnel, etc.

The Prior Art

Self-releasing hooks are known in the prior art.

For example, U.S. Pat. No. 2,490,558, issued Dec. 6, 1949 to Sullivan, discloses a quick-release mechanism for a parachute in which, as soon as the load on the chute is relieved, a pivotally mounted housing swings in a clockwise direction under the urging of a spring, thus releasing a loop which leads to the parachutist.

U.S. Pat. No. 3,259,420, issued Jul. 5, 1966 to Klemm, discloses a relatively simple mechanism which allows a pivotal ejector to remove a rope or strap from a hook, upon release of the load on the rope.

U.S. Pat. No. 4,095,833, issued Jun. 20, 1978 to Lewis, provides a construction in which a hook is pivoted about a pin to a main body, and receives a downward load along a direction which is displaced laterally from the axis of the pivot pin. Because of the displacement, any load on the hook will seek to rotate the hook to a position in which the load will simply "fall off" the hook.

The prior art constructions illustrated by the patents mentioned above are not suitable for large loads due to the risk of failure of certain components.

GENERAL DESCRIPTION OF THIS INVENTION

Accordingly, it is an aspect of this invention to provide a self-releasing hook for substantial loads, utilizing hydraulics in combination with mechanical components to ensure the release of a load from a hook immediately upon "touch down" of the load, and without requiring any action from the operator aside from lowering the load onto a receiving surface.

More particularly, this invention provides a self-releasing lift hook, comprising:

a main cylinder, a main piston slidable in said main cylinder, the main cylinder defining two main chambers, one on either side of the main piston, a fluid medium in each main chamber, downwardly extending hook means connected to one of said cylinder and said piston, upwardly extending lift means connected to the other of said cylinder and said piston, main resilient means biasing the piston in a direction which causes the hook means and the lift means to approach each other, such that when a load is placed on the hook means the hook means and lift means move apart and energy is stored in the main resilient means, a main passage through the main piston and a check valve in the main passage, such that fluid can flow between the main chambers through said main passage when the hook means and lift means are moving apart, but is restrained from flowing between the main chambers through said main passage when the hook means and lift means approach each other, a bleed passage communicating with that main chamber which decreases in volume when the hook means and lift means approach each other, the bleed passage allowing a relatively slow escape of fluid from said last-mentioned main chamber, fluid means activated by an increase of fluid pressure in that main chamber which decreases in volume when the hook means and lift means approach each other, and mechanical means activated by said fluid means, the mechanical means being adapted, upon activation, to release a load attachment from said hook means.

GENERAL DESCRIPTION OF THE DRAWINGS

Three embodiments of this invention are illustrated in the accompanying drawings, in which like numerals denote like parts throughout the several views, and in which.

DETAILED DESCRIPTION OF THE DRAWINGS

Figure 1:
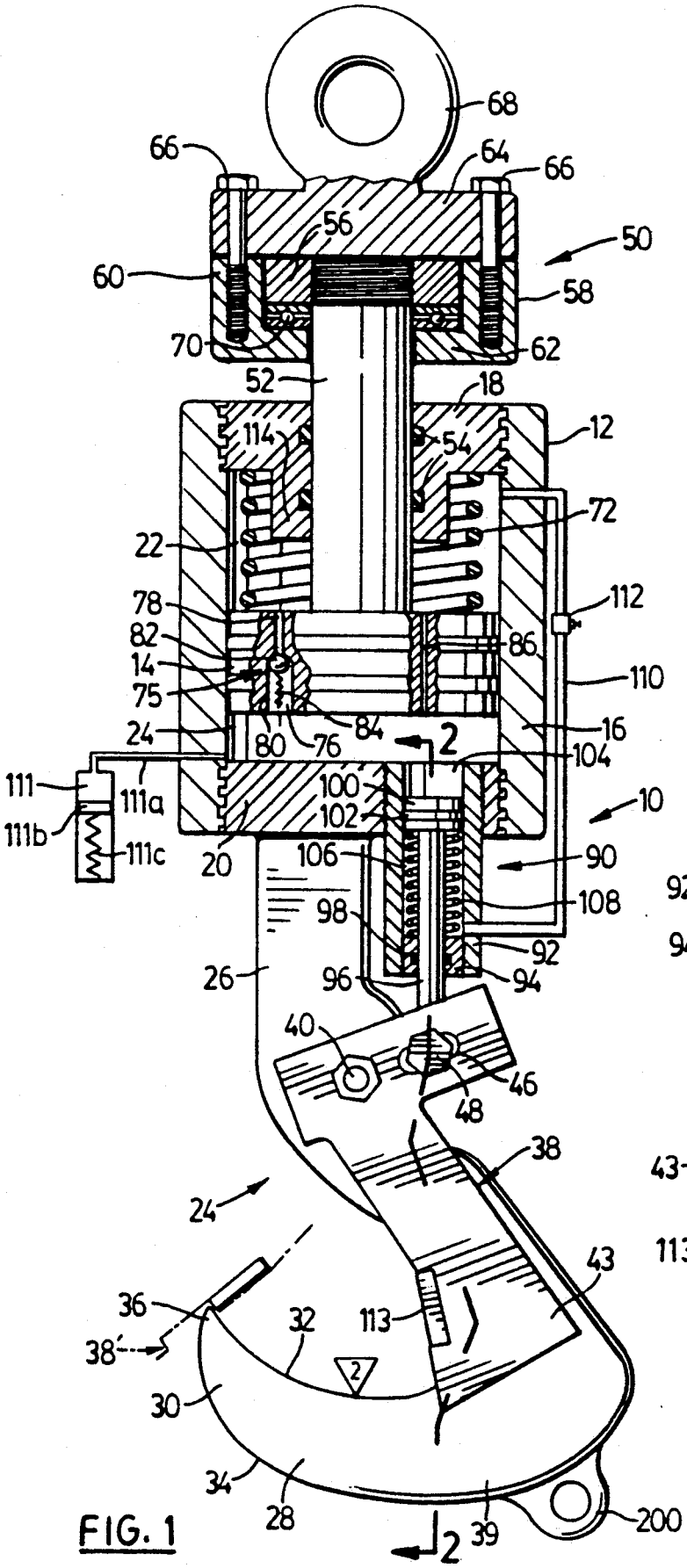
FIG. 1 is an elevational view of one embodiment of this invention.

Attention is directed firstly to FIG. 1, showing a self-releasing lift hook generally at 10, which includes a main cylinder 12 and a main piston 14 slidable in the main cylinder 12. More particularly, the main cylinder 12 includes a cylindrical outer wall 16 threadably engaged with an upper threaded plug 18, and threadably engaged with a lower threaded plug 20. The outer wall 16 and the two plugs 18 and 20 thus define an interior space within which the main piston 14 slides. Thus, within the main cylinder 12 there are two main chambers, one on either side of the main piston 14. Even more specifically, there is provided an upper chamber 22 between the main piston 14 and the upper plug 18, and a lower chamber 24 between the main piston 14 and the lower plug 20.

Suitable seal means are provided between the cylindrical outer wall 16 and each of the plugs 18 and 20.

The continuing description below assumes that hydraulic oil or the like is the working fluid contacting the various cylinders, pistons, etc. It will be explained subsequently, however, that it is not essential to utilize hydraulic oil. In some circumstances, air or another gas could be utilized as the working fluid. In the case where the entire assembly is at all times submerged in salt water, the salt water itself could constitute the working fluid.

A downwardly extending hook means 24 is connected to the lower plug 20 by welding or the like, and is thus fixed with respect to the cylinder 12. The hook means includes a neck portion 26 extending rectilinearly downwardly from the lower plug 20, and a curved portion 28 defining the actual hook 39, which is somewhat in the shape of an inverted question mark. More specifically, the curvilinear portion 28 defines a terminal region 30 which has an upwardly concave upper surface 32 and a downwardly convex lower surface 34, converging to a point 36. A triangle labelled 2 indicates the location on the terminal region 30 where a load would typically be applied.

Figure 2:
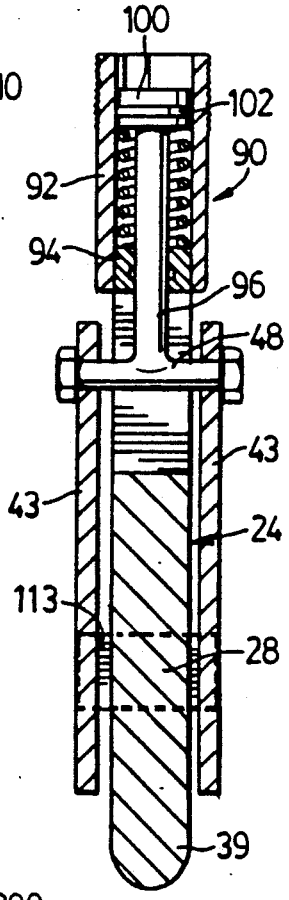
FIG. 2 is a sectional view of the structure of FIG. 1, taken at the line 2—2 in FIG. 1.

A mechanical release means shown generally at 38 is pivoted to the hook means 24 at a pivot location 40, and is adapted to swing between a retracted position shown in solid lines in FIG. 1, and a load release position partly shown in broken lines in FIG. 1 and identified by the numeral 38'. As can be seen in FIG. 2, the release means 38 consists of two identical swing arms 43, one on either side of the curvilinear portion 28 of the hook 39. Each of the swing arms 43 has roughly a T-shaped configuration, with the stem of the "T" extending downwardly and acting to release the load. The cross-bar of the "T" contains the pivot location 40, and also contains an elongate slot 46 adapted to receive a cross-bar 48. More specifically, looking at FIG. 2, the cross-bar 48 has one end in engagement with each of the swing arms 43. It is clearly seen in FIG. 1 that, when the cross-bar 48 moves downwardly, the swing arms 43 swing in a clockwise direction and sweep the load 2 off the hook means 24. In other words, downward movement of the cross-bar 48 swings the swing arms 43 from the solid-line position in FIG. 1 to the broken line position in FIG. 1. Conversely, upward movement of the cross-bar 48 will retract the swing arms 43 from the broken line position to the solid-line position.

Attention is now directed toward the upper portion of FIG. 1, including the cylinder 12, for further details of construction.

It will be noted that the upper portion of FIG. 1 includes an upwardly extending lift means 50 which includes a piston rod 52 that is connected to the main piston 14, and that passes upwardly through a suitably sized bore in the upper plug 18, equipped with a pair of circumferential seals 54. At the top of the piston rod 52 there is provided an outwardly extending flange 56 which may be attached by welding, threaded connection, or the like. There is further provided an enclosure 58 which includes a cylindrical side wall 60, an annular base wall 62, and a disk-like top wall 64 which is secured to the side wall 60 by threaded members 66. A lift ring 68 is secured to the disk-like top wall 64 by welding or otherwise.

Within the chamber defined by the side wall 60, the base wall 62 and the top wall 64, the flange 56 rests upon roller bearings 70, thus allowing the cylinder 12 and the hook means 24 to rotate about a vertical axis with respect to the upper structure 50, including the ring 68.

The operation of the upper portion of the apparatus shown in FIGS. 1 and 2 will now be explained. When a load is placed at 2 on the hook means 24, and a corresponding lift is exerted upwardly on the ring 68, the main piston 14 is pulled upwardly against the resistance of a biasing means, this being constituted in the present embodiment by a compression coil spring 72. Thus, energy is stored in the spring 72 as the upper chamber 22 diminishes in volume, and as the ring 68 and hook means 24 move apart from each other. In the embodiment under discussion, the upper chamber 22, the lower chamber 24, and certain other portions to be described subsequently are all filled with hydraulic oil. Means are provided to allow the hydraulic oil in the upper chamber 22 to escape therefrom as the main piston 14 moves upwardly with respect to cylinder 12. This escape takes place primarily through a check valve shown generally at 75, which is seen to incorporate a passageway 76 extending completely through the main piston 14, with a smaller diameter portion 78 in the upper part of the main piston 14 and a larger diameter portion 80 in the lower part of the main piston 14. These portions of differing diameter meet about mid-way of the piston 14, where a ball-type check valve is located, including a ball 82, and a spring 84 which normally urges the ball 82 upwardly into a sealed relationship with the upper portion 78 of the passageway 76.

It is thus seen that hydraulic liquid can flow from the upper chamber 22 downwardly to the lower chamber 24 past the check valve 75, so long as the differential pressure between the two chambers is sufficient to overcome the force of the spring 84.

The main piston 14 also includes a bleed passage 86 through which hydraulic liquid in one of chambers 22 and 24 can bleed into the other. However, the purpose of the bleed passage 86 is not primarily to allow hydraulic fluid to flow from the upper to the lower chamber. Its function will become evident from the description that follows.

In the first embodiment illustrated in FIGS. 1 and 2, there is a hydraulic means 90 which is distinguishable from the cylinder 12. More specifically, the hydraulic means 90 incorporates a cylindrical side wall 92 threadably engaging the lower plug 20, and a cylindrical plug 94 in the bottom of the side wall 92, the plug having a central passageway through which a further piston rod 96 passes. A seal 98 is provided around the piston rod 96 in order to prevent leakage of hydraulic liquid under pressure. The piston rod 96 is attached, at its upper end, to an auxiliary piston 100 which is equipped with a seal 102. The side wall 92 and the plug 94 thus define an auxiliary cylinder, and the auxiliary piston 100 divides the auxiliary cylinder into two auxiliary chambers: one above the piston 100 and identified by the numeral 104, and one below the piston 100 identified by the numeral 106. A compression coil spring 108 is located in the lower auxiliary chamber 106, constantly urging the piston 100 upwardly. The auxiliary chamber 104 is in direct communication with the lower chamber 24.

To continue the description of the hydraulic arrangement, it will be seen in FIG. 1 that a conduit 110 is provided to link the lower auxiliary chamber 106 with the upper main chamber 22. The conduit 110 is provided with a needle valve 112 in order to adjust the rate at which hydraulic fluid passes from the chamber 106 to the chamber 22.

At its lower end, the piston rod 96 is affixed to the cross bar 48, such that vertical movement of the piston rod 96 will result in corresponding swiveling movement of the release means 38 which is constituted by the swing arms 43. It is to be understood that the shape and orientation of the slots 46, engaged by the cross bar 48, will be selected in such a way as to minimize lateral forces on the piston rod 96, thus minimizing the risk that the piston rod 96 will bind in the plug 94.

Finally, a reservoir 111 for hydraulic fluid under pressure is in constant communication through a conduit 111*a* with the auxiliary chamber 104, to accommodate the fact that, as the main piston 14 moves vertically, the sum of the volumes of the chambers 22 and 24 does not remain constant. The hydraulic fluid in the reservoir 111 is maintained under pressure by a floating piston 111*b* under the urging of a spring 111*c*.

Continuing with the operation of the apparatus shown in FIG. 1, assume that, shortly after the load at 2 is lifted by the ring 68, the main piston 14 will have moved up against the upper plug 18 (specifically the downwardly extending boss 114 thereof). Virtually all of the displaced oil will have passed through the passageway 76 which contains the check valve 75.

During this time, the auxiliary piston 100 will remain in its uppermost position (shown in FIG. 1) because it is not allowed to rise further due to the engagement of the cross bar 48 with the slots 46. A mechanical stop means is provided to limit the counterclockwise rotation of the swing arms 43 at the position shown in solid lines in FIG. 1. Specifically, a lateral bar 113 is welded across the swing arms 43 and contacts the hook 39 to determine the furthest counterclockwise position of the release means 38.

As the main piston 14 is rising upwardly toward the upper plug 18, there is an increase in pressure in the upper chamber 22, and a decrease in pressure in the lower chamber 24. The auxiliary chamber 104 will have the same pressure as the lower chamber 24, because they open directly into each other.

Imagine now that the load at 2 on the hook means 24 touches down on a receiving surface. When this happens, there is no longer any separating force being applied between the ring 68 and the hook 39. This will allow the compression coil spring 72 to push downwardly on the main piston 14, as the spring 72 seeks to return to its unloaded condition. Because of the check valve 75 in the main piston 14, no oil will move from the lower chamber 24 to the upper chamber 22 along the passageway 76. A tiny portion of the oil will pass upwardly through the bleed passage 86, but the quantity which moves through the bleed passage 86 is not significant.

Of more importance is the fact that, as the spring 72 pushes the main piston downwardly, there is an increase in hydraulic pressure in the lower chamber 24. This is communicated directly to the auxiliary chamber 104, and the increased pressure pushes downwardly on the auxiliary piston 100. This downward push is transmitted along the piston rod 96 to the cross-bar 48. The conduit 110 allows hydraulic fluid from the lower auxiliary chamber 106 to move into the upper main chamber 22, the rate being determined by the needle valve 112. As the piston 100 moves downwardly, the cross bar 48 pushes downwardly against the slot 46, and the swing arms 43 move clockwise toward the release position shown in broken lines at 38' in FIG. 1, thus clearing the loop, rope, or shackle from the hook 39.

After the load has been released from the hook, and the latter is simply dangling free from the ring 68, the compression coil spring 72 will continue to push the main piston 14 downwardly (if it has not already reached the lowermost position, in which it abuts the lower plug 20).

At the same time, the auxiliary spring 108 will push upwardly against the auxiliary piston 100, and begin to move it upwardly. During the release phase just concluded, the downward force against the auxiliary piston 100 due to the increased hydraulic pressure in the auxiliary chamber 104 was sufficient to overcome the auxiliary spring 108 and cause it to compress. Now, however, the pressure in the auxiliary chamber 104 is relieved, and the piston 100 rises upwardly (as previously mentioned) under the urging of the spring 108. Because the upper chamber 22 has now reached its maximum size (with the main piston 14 at its lowermost position), it is not possible for hydraulic fluid to enter the lower auxiliary chamber 106 along the conduit 110 as the volume of the auxiliary chamber 106 increases. Instead, the rising auxiliary piston 100 displaces hydraulic fluid out of the lower chamber 24 along the bleed passage 86 and into the upper main chamber 22. This continues until the auxiliary piston 100 again reaches its uppermost position, as determined by the limitation on the counter-clockwise pivoting of the swing arms 43. Thus, the swing arms 43 will have moved in the counterclockwise direction back to the solid-line position shown in FIG. 1, and the apparatus is now ready for another cycle.

During the upward movement of the auxiliary piston 100, the reservoir 111 again comes into play to absorb oil which must escape to allow the upward movement of the piston rod 96 into the space within the cylindrical side wall 92.

Figure 3:
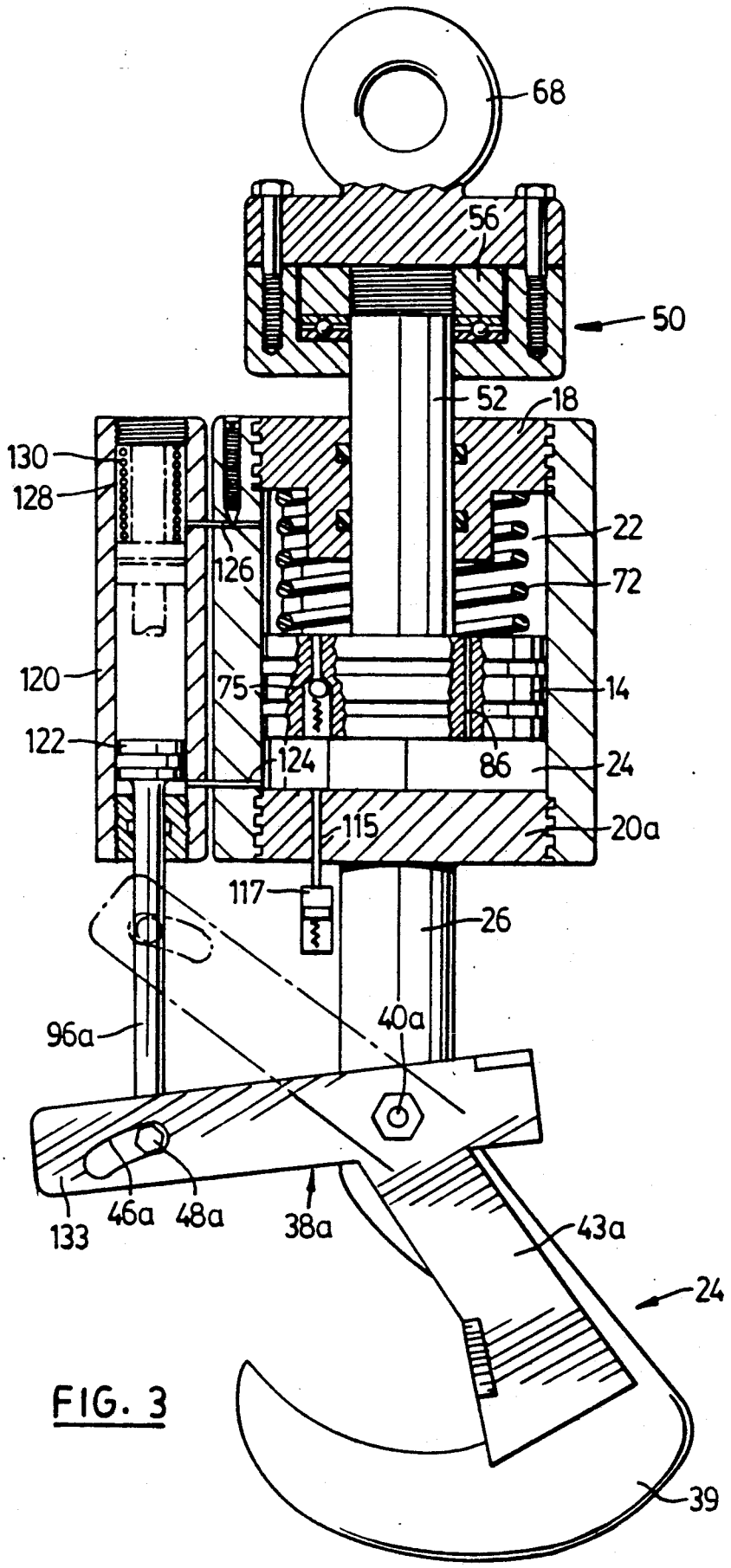
FIG. 3 is a side elevation of a second embodiment of this invention.

Attention is now directed to FIG. 3, which shows an alternative embodiment of this invention.

The apparatus shown in FIG. 3 is very similar to the embodiment of FIG. 1, except for the mechanism which permits an increase in pressure in the lower main chamber to cause swing arms to rotate and clear the hook of a load.

Looking at FIG. 3, the upper swivel apparatus 50 remains the same as in FIG. 2. Likewise, the main cylinder 12 has the same construction and function as that in FIG. 1. In FIG. 3 only the main components have numerals, in order to avoid cluttering the drawing. All identical components have the same numerals.

A distinction from the FIG. 1 construction is found in the lower plug 20*a*, which provides, for the space defined within the cylinder 12, a solid bottom wall penetrated only by a conduit 115 leading to a fluid make-up reservoir 117 functioning exactly as the reservoir 111 in FIG. 1. The hook means 24 has the same shape as shown in FIG. 1, and is again welded or otherwise firmly affixed to the lower plug 20*a*.

In FIG. 3 the provision of the auxiliary hydraulic means is different from that in FIG. 1. Specifically, in FIG. 3 an auxiliary cylinder 120 is secured by welding or otherwise against the outer surface of the main cylinder 12. An auxiliary piston 122 is shown closely adjacent the bottom of the interior of the cylinder 120, the space under the auxiliary piston 122 being directly in communication with the lower chamber 24 along a passageway 124. Similarly, a passage 126 provides communication between the upper chamber 22 and the space above the auxiliary piston 122, this space having the numeral 128. A compression coil spring 130 is provided within the cylinder 120 above the piston 122.

Just as in the FIG. 1 embodiment, the hook means 24 is provided with release means 38*a* which incorporates two substantially identical swing arms, one on either side of the actual hook 39, the swing arms being pivoted at the location 40*a* to the hook 39.

The operation of the FIG. 3 embodiment is substantially identical to that of the FIG. 1 embodiment. Briefly, when a load is first picked up, the main piston 14 rises upwardly to contact the upper plug 18, gradually compressing the compression coil spring 72 and storing energy therein.

Upon touch down of the load, the compression coil spring 72 is allowed to shove the main piston downwardly with respect to the cylinder 12, thus expelling hydraulic fluid from the lower main chamber 24 through the passageway 124 and into the space beneath the auxiliary piston 122. This causes the auxiliary piston 122 to rise upwardly toward its broken-line position in FIG. 3, against the downward force of a compression coil spring 130 located above the piston 122 within the cylinder 120. The auxiliary piston 124 is connected to a piston rod 96*a*, which has a cross-bar 48*a* adapted to engage, at each of its ends, a slot 46*a* in an arm 133 which is an integral part of the respective swing arm 43*a*. It will be noted that the swing arm 43*a* in FIG. 3 has a shape different from that of the swing arm 43 in FIG. 1. Upward movement of the cross bar 48 causes the swing arms 43*a* to move in the clockwise direction about the pivot 40*a*, thus sweeping the rope or link off the hook 39.

The primarily distinction between the embodiments of FIGS. 1 and 3 is the fact that clearing the load off the hook involves downward movement of the auxiliary piston 100 in FIG. 1, whereas it involves upward movement of the auxiliary piston 122 in FIG. 3.

Figure 4:
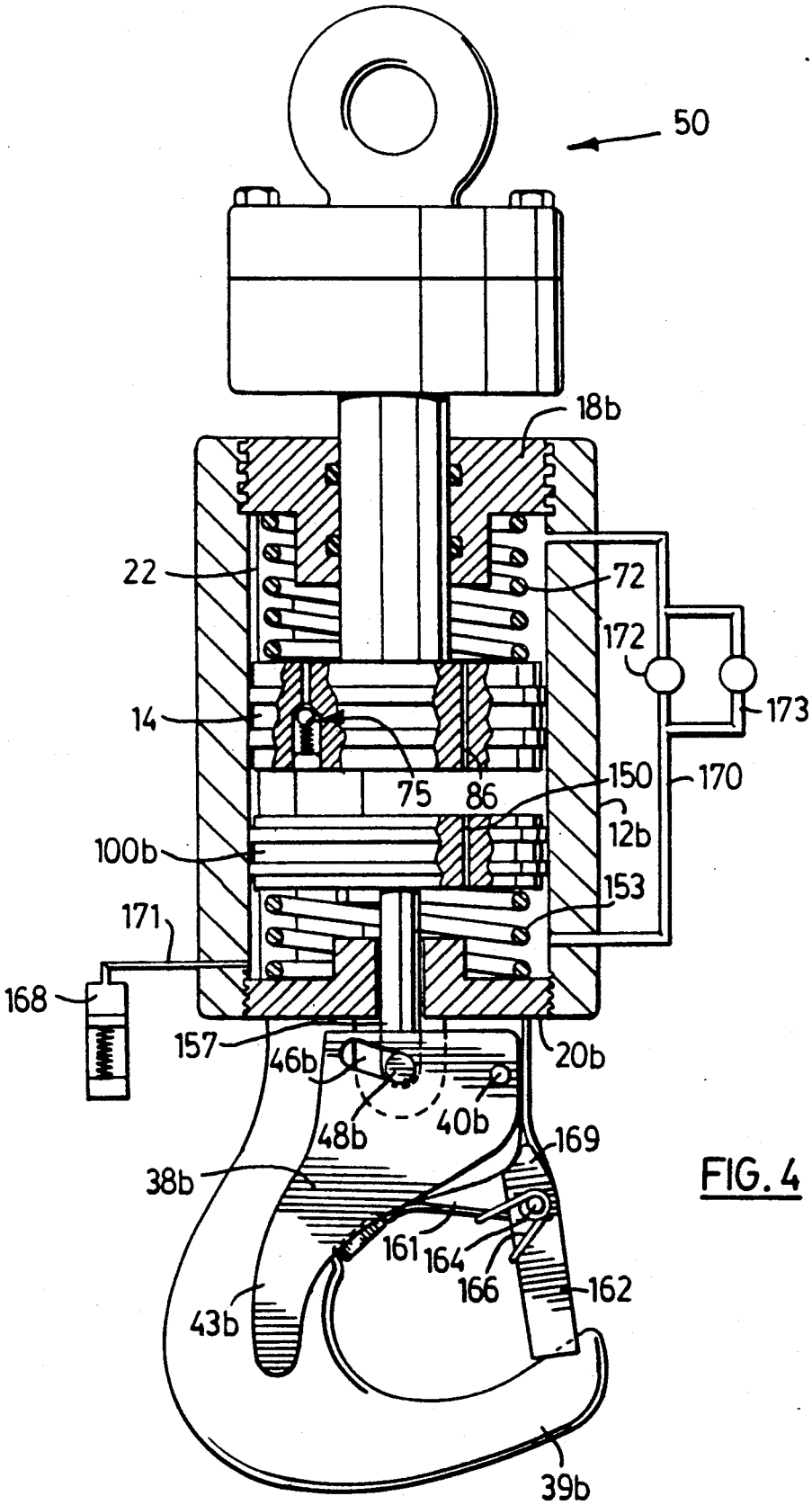
FIG. 4 is a side elevation of a third embodiment of this invention.

Attention is now directed to FIG. 4, which illustrates the third embodiment of this invention. In the embodiment shown in FIG. 4, the hook 39*b* is again connected to the main cylinder 12*b*, and the lift means 50 is again connected to the main piston 14. A lower plug 20*b* closes the bottom end of the cylinder 12*b*, while an upper plug 18*b* closes the upper end of the cylinder 12*b*. As in the first embodiment, a compression coil spring 72 is provided in the chamber which lies above the main piston 14. In the space provided below the main piston 14 and within the cylinder 12*b* there is provided a second piston which (as will be seen) constitutes an auxiliary piston 100*b* that operates analogously to the auxiliary piston 100 shown in FIG. 1.

Again, as in the other embodiments, the main piston 14 is provided with a check valve 75 and a bleed passage 86.

In operation, when the lift means 50 raises the apparatus upwardly with the load on the hook 39*b*, the main piston 14 again rises upwardly to contact the upper plug 18*b*, at the same time compressing the compression coil spring 72 to store energy therein. Hydraulic fluid passes from the upper chamber 22 to the chamber below the piston 14 along the passageway 76 of the check valve 75, and to a lesser extent through the bleed passage 86.

The auxiliary piston 100*b* has only a small bleed passage 150, and therefore it will tend to rise upwardly under the main piston 14, by virtue of both the "suction" under the main piston 14, and the upward urging of a compression coil spring 153 located beneath the auxiliary piston 100*b* and above the lower plug 20*b*.

The auxiliary piston 100*b* is connected to a piston rod 157 extending downwardly through the lower plug 20*b* and supports at its lower end a cross-bar 48*b* having oppositely extending ends that engage in slots 46*b* in a release means 38*b* constituted by two substantially identical swing arms, one on either side of the hook 39*b*, adapted to swing about a pivot location 40*b*.

In the embodiment shown in FIG. 4, the hook 39*b* has a forwardly extending nose portion 161 to which a latch 162 is pivoted at the axis 164. A spring 166 seeks to urge the latch 162 to its furthest counterclockwise position, which is that shown in solid lines in FIG. 4. The latch 162 has an upper cam portion 169 which is adapted to be pushed rightwardly as the swing arms 43*b* move in the counter-clockwise direction. The latch 162 thus rotates in the clockwise direction to lift its lower end out of the way of the loop or rope originally holding the load.

As in the earlier embodiments, the apparatus of FIG. 4 also includes a make-up reservoir 168 connected along a conduit 171 with the chamber 20*b*.

In order to understand what causes the swing arms 43*b* to rotate in the counter-clockwise direction upon load release, begin with the fully loaded condition in which the main piston 14 is pressing against the upper plug 18*b* with the spring 72 fully compressed, and with the auxiliary piston 100*b* in its highest possible position, as limited by the furthest clockwise position of the swing arms 43*b*.

As soon as the load is released, the compression coil spring 72 urges the main piston 14 downwardly. Because there is no easy passageway along which the oil trapped between the two pistons can escape (only the bleed passages 86 and 150), the auxiliary piston 100*b* immediately moves downwardly against the pressure of the compression coil spring 153, thus rotating the swing arms 43*b* in the counter-clockwise direction, simultaneously sweeping the loop or shackle off the hook 39*b* and rotating the latch 162 counter-clockwise about the pivot location 164. After this has happened, the compression coil spring 153 gradually raises the auxiliary piston 100*b* upwardly, to swing the swing arms 43*b* in the counter-clockwise direction back to the position shown in FIG. 4. At the same time, the latch 162 returns to its position as illustrated in FIG. 4.

The check valve 75 and bleed passage 86 can be replaced with a passageway 170 which allows transfer of hydraulic fluid from the space beneath the auxiliary piston 100*b* to the space above the main piston 14, while the piston 100*b* is moving downwardly to release the load from the hook 39*b*. The passageway 170 is provided with a check valve 172, which assumes the function of the check valve 75, along with a flow control bypass 173 which takes the place of the bleed passage 86.

The various embodiments illustrated in the drawings have been described on the assumption that hydraulic liquid is used as the working fluid. However, those skilled in the art will realize that any other suitable liquid, or a gas, could be used in place of a hydraulic liquid.

More specifically, for a unit operating in air, utilizing air as the working fluid, and constructed as illustrated in FIG. 1, there would be no necessity for joining the auxiliary chamber 106 with the upper main chamber 22 along the conduit 110. The lower auxiliary chamber 106 could simply be vented directly to the ambience, preferably with a flow control device to adjust the rate at which air enters and leaves the auxiliary chamber 106.

Similarly, the upper main chamber 22 could be vented directly to the atmosphere. Also, the reservoir 111 and conduit 111*a* could also be omitted.

For a unit constructed as illustrated in FIG. 1 but working entirely below the surface of the sea or ocean, again the auxiliary chamber 106 and the upper main chamber 22 could be in direct and continuous communication with the ambient water, thus dispensing with the need for the conduit 110. The reservoir 111 and conduit 111*a* could also be omitted.

For the units illustrated in FIGS. 3 and 4, operating with a working fluid that is the same as the surrounding fluid (air or water), again the primary chambers could be directly communicated with the ambience and the reservoir (117 or 168) could be omitted, along with the feed conduit for the reservoir.

Figure 5:
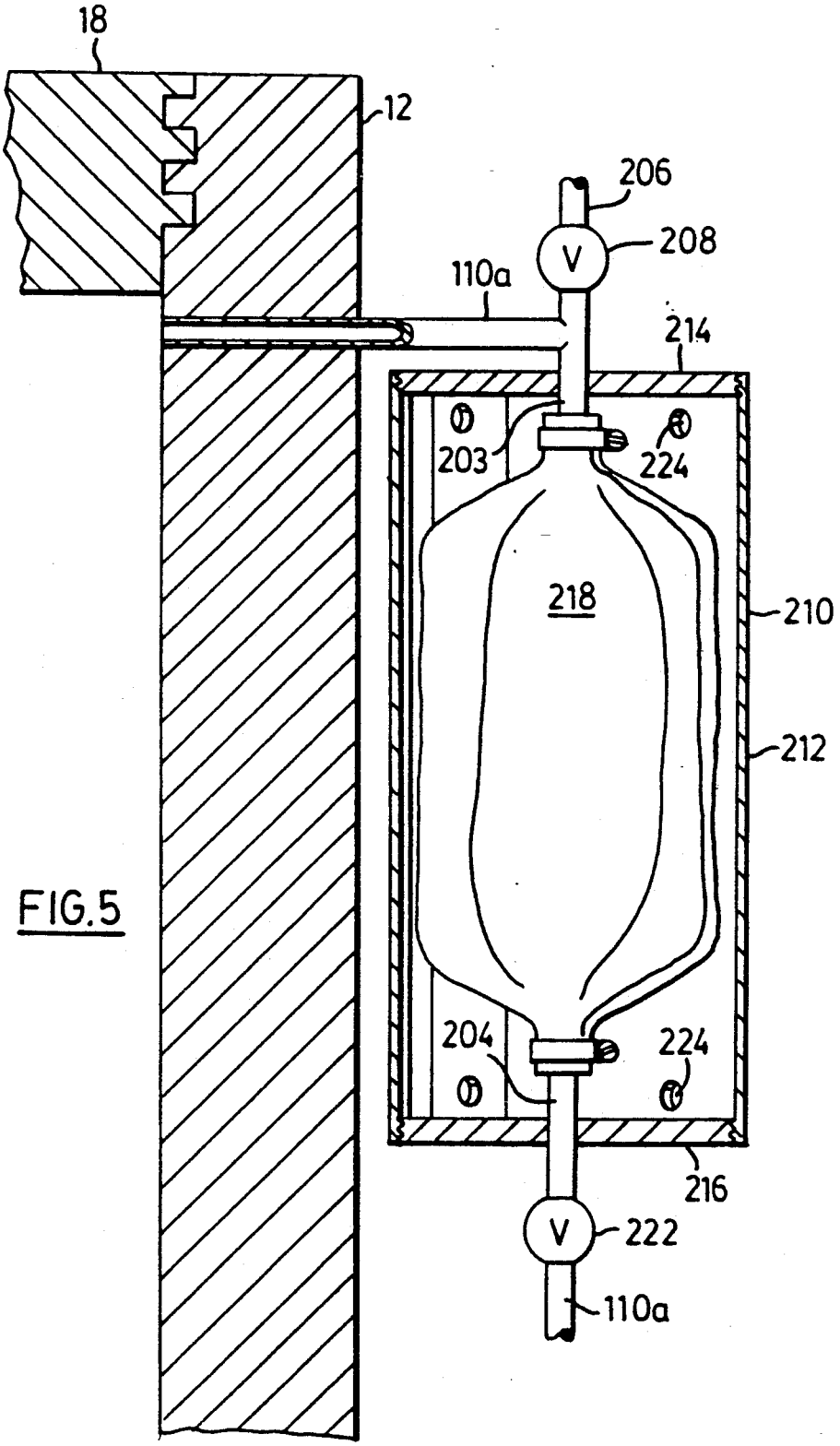
FIG. 5 is an enlarged, partial, vertical sectional view showing an alternative construction.

Attention is now directed to FIG. 5, which illustrates an optional device capable of accomplishing the same function as the reservoirs 111, 117 and 168. More specifically, the unit shown in FIG. 5 would be placed in the conduit 110 in FIG. 1, this conduit being designated 110*a* in FIG. 5. It will be noted that the conduit 110*a* is discontinuous, so that there is defined a first end 203 and a second end 204. The upper part of conduit 110*a* is, in effect, the stem of a T-junction of which one arm is the end shown at 203, and of which the other arm 206 is provided for venting purposes. A valve 208 is provided in the arm 206.

In FIG. 5, a cylindrical container 210 is illustrated, having a cylindrical side wall 212, an upper circular wall 214 and a lower circular wall 216. The walls 214 and 216 may be threadably engaged with the upper and lower ends, respectively of the cylindrical side wall 212. The end 203 passes through a central aperture in the upper wall 214, while the lower end 204 passes upwardly through a central opening in the bottom wall 216. As can be seen in the Figure, a flexible bladder 218, typically made of rubber, has an opening at the top which is clamped around the arm 203, and further has an opening at the bottom which is clamped around the end 204 of the conduit 110*a*.

A further valve 222 is provided in the conduit 110*a*below the container 210. The cylindrical side wall 212 contains a plurality of vent holes 224, thus allowing the entry and exit of air into and out of the container 210, as the bladder volume changes.

In the operation of the FIG. 1 structure, as the coil spring 72 pushes the main piston 14 downwardly following touchdown of the load, the amount of fluid called for by the expanding upper chamber 22 is less than the amount of fluid expelled by the lower chamber 24 (due to the presence of the piston rod 52). This will mean that more fluid enters the bladder 223 from the bottom than is removed from the bladder at the top. As a result, the bladder 223 will increase in size.

Conversely, when a new weight is picked up by the hook 39, causing the main piston 14 to move upwardly with respect to the cylinder 12, the amount of working fluid required to fill the expanding lower chamber 24 is less than the amount of working fluid expelled by the upper chamber 22, and this will cause the bladder 223 to shrink in size.

In the appended claims, the word "fluid" is intended to include any appropriate liquid or gaseous medium that will allow the apparatus to function.

It will be understood that the auxiliary cylinder, such as that shown at 90 in FIG. 1, does not need to be connected to or form a specific part of the main cylinder. The auxiliary cylinder can be removed some distance from the main cylinder, so long as the appropriate hydraulic connections were made. For example, the auxiliary cylinder could be utilized to control an "ice-tongs" for lifting block-like items, such as solid concrete.

A further variant of operation involves the provision of a ring 200 which may be integral with or firmly affixed to the hook 39 in the FIG. 1 embodiment. The ring 200 can be utilized with a cable useful to lift parcels and the like, when it is desired that the cable remain with the hook. In this instance, one end of the cable would be firmly affixed to the ring 200, and the other end of the cable would have a loop that would fit over the terminal region 30 of the hook 39. Upon release, the release means 38 would sweep the loop of the cable off the terminal region 30 of the hook 39, while the other end of the cable remained firmly affixed to the ring 200. Then, as the hook is raised away from the deposited load, the cable would be withdrawn from contact with the load and would remain connected to the hook 39.

While three embodiments of this invention have been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. A self-releasing lift hook, comprising:

a main cylinder, a main piston slidable in said main cylinder, the main cylinder defining two main chambers, one on either side of the main piston, a fluid medium in each main chamber, downwardly extending hook means connected to one of said cylinder and said piston, upwardly extending lift means connected to the other of said cylinder and said piston, main resilient means biasing the piston in a direction which causes the hook means and the lift means to approach each other, such that when a load is placed on the hook means the hook means and lift means move apart and energy is stored in the main resilient means, a main passage interconnecting said main chambers and a check valve in the main passage, such that fluid can flow between the main chambers through said main passage when the hook means and lift means are moving apart, but is restrained from flowing between the main chambers through said main passage when the hook means and lift means approach each other, a bleed passage communicating with that main chamber which decreases in volume when the hook means and lift means approach each other, the bleed passage allowing a relatively slow escape of fluid from said last-mentioned main chamber.

fluid means activated by an increase of fluid pressure in that main chamber which decreases in volume when the hook means and lift means approach each other, and mechanical means activated by said fluid means, the mechanical means being adapted, upon activation, to release a load attachment from said hook means.

2. The lift hook claimed in claim 1, in which said fluid means includes: an auxiliary cylinder containing an auxiliary piston which divides the auxiliary cylinder into two auxiliary chambers, a first passageway communicating one auxiliary chamber with that main chamber which decreases in volume when the hook means and lift means approach each other, and a second passageway permitting fluid to enter and exit the other auxiliary chamber; and in which the mechanical means includes release lever means pivotally mounted to the hook means at a lever axis and adapted to swing through an arc in order to release the load on the hook means, and connection means by which movement of the auxiliary piston causes said release lever means to swing through said arc.

3. The lift hook claimed in claim 1, in which the hook means is connected to the main cylinder, and the lift means is connected to the main piston.

4. The lift hook claimed in claim 1, in which said main resilient biasing means is a compression coil spring.

5. The lift hook claimed in claim 3, in which said main resilient biasing means is a compression coil spring located in the main chamber which decreases in volume when the hook means and the lift means move apart.

6. The lift hook claimed in claim 2, in which said connection means is a piston rod connected to said auxiliary piston, the piston rod supporting, remote from the auxiliary piston, an engagement means which registers in slot means on the release lever means, the slot means being spaced away from said lever axis, such that reciprocating longitudinal movement of said piston rod causes reciprocating rotational movement of said release lever means about said lever axis.

7. The lift hook claimed in claim 6, in which the hook means is connected to the main cylinder, the lift means is connected to the main piston; said main resilient biasing means is a compression coil spring located in the main chamber which decreases in volume when the hook means and the lift means move apart, and said main passage passes through the main piston.

8. The lift hook claimed in claim 2, in which the main cylinder is oriented with its axis vertical during operation, the main chamber which decreases in volume as the lift means and the hook means approach each other being situated below the main piston, said auxiliary cylinder being directly below and in immediate communication with said main chamber which decreases in volume as the lift means and the hook means approach each other.

9. The lift hook claimed in claim 8, in which said hook means includes a hook generally shaped as an inverted question mark, and in which said release lever means includes two substantially identical swing arms, one on either side of said hook, said connection means being a piston rod connected to said auxiliary piston, the piston rod supporting, remote from the auxiliary piston, a lateral cross-bar having two ends which register in similar slots on the swing arms, the slots being spaced away from said lever axis, such that reciprocating longitudinal movement of said piston rod causes reciprocating rotational movement of said swing arms about said lever axis.

10. The lift hook claimed in claim 1, in which the hook means is connected to the main cylinder, and the lift means is connected to the main piston; in which said fluid means includes: an auxiliary piston in said main cylinder but located below the main piston, a first passageway extending through said auxiliary cylinder to communicate the space below the auxiliary piston with the space above the auxiliary piston; a second passageway communicating the space below the auxiliary piston with the main chamber above the main piston; and in which the mechanical means includes release lever means pivotally mounted to the hook means at a lever axis and adapted to swing through an arc in order to release the load on the hook means, and connection means by which movement of the auxiliary piston causes said release lever means to swing through said arc.

11. The lift hook claimed in claim 10, in which said main resilient biasing means is a compression coil spring located in the main chamber above said main-piston, and in which said main passage passes through the main piston.

12. The lift hook claimed in claim 10, in which said connection means is a piston rod connected to said auxiliary piston, the piston rod supporting, remote from the auxiliary piston, an engagement means which registers in slot means on the release lever means, the slot means being spaced away from said lever axis, such that reciprocating longitudinal movement of said piston rod causes reciprocating rotational movement of said release lever means about said lever axis.

13. The lift hook claimed in claim 10, in which the main cylinder is oriented with its axis vertical during operation.

14. The lift hook claimed in claim 10, in which said hook means includes a hook generally shaped as an inverted question mark with an access mouth, and in which said release lever means includes two substantially identical swing arms, one on either side of said hook, said connection means being a piston rod connected to said auxiliary piston, the piston rod supporting, remote from the auxiliary piston, a lateral cross-bar having two ends which register in similar slots on the swing arms, the slots being spaced away from said lever axis, such that reciprocating longitudinal movement of said piston rod causes reciprocating rotational movement of said swing arms about said lever axis.

15. The lift hook claimed in claim 14, in which the hook includes a safety latch pivotally mounted to the hook for swinging movement between an operating position in which it blocks said access mouth and a release position in which it unblocks said access mouth, the safety latch being resiliently biased toward said operating position, the safety latch having a cam surface which is contacted by at least one of said swing arms as they sweep along the hook, such contact causing the safety latch to swing toward its release position.

16. The lift hook claimed in claim 1, in which the bleed passage is provided in said main piston and interconnects the two main chambers.

17. The lift hook claimed in claim 2, in which the bleed passage is provided in said main piston and interconnects the two main chambers, said second passageway communicating said other auxiliary chamber with the other of the main chambers.

18. The lift hook claimed in claim 2, in which said second passageway interconnects said other auxiliary chamber with that main chamber which increases in volume when the hook means and lift means approach each other.

19. The lift hook claimed in claim 18, in which said second passageway includes a flexible bladder means of which the volume can vary, thereby accommodating changes in the sum of the volumes of both main chambers arising because of the volume of said main piston.

20. The lift hook claimed in claim 18, in which the volume of the second passageway is unvarying, and the lift hook further comprising a reservoir communicating with one of said main chambers, the reservoir having a variable volume and means for pressurizing fluid in said reservoir, whereby to accommodate changes in the sum of the volumes of both main chambers arising because of the volume of said main piston.

* * * * *